US009285756B2

(12) United States Patent
Kashiide et al.

(10) Patent No.: US 9,285,756 B2
(45) Date of Patent: Mar. 15, 2016

(54) REGULATING DEVICE, IMAGE BEARING MEMBER CLEANING DEVICE, DEVELOPING DEVICE, CLEANING DEVICE, PROCESS CARTRIDGE AND IMAGE FORMING APPARATUS

(71) Applicant: CANON KABUSHIKI KAISHA, Tokyo (JP)

(72) Inventors: Yosuke Kashiide, Susono (JP); Susumu Nittani, Suntou-gun (JP); Hideki Maeshima, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/340,807

(22) Filed: Jul. 25, 2014

(65) Prior Publication Data

US 2014/0334845 A1 Nov. 13, 2014

Related U.S. Application Data

(62) Division of application No. 13/085,710, filed on Apr. 13, 2011, now Pat. No. 8,831,487.

(30) Foreign Application Priority Data

Apr. 20, 2010 (JP) ..... 2010-096779
Apr. 4, 2011 (JP) ..... 2011-082640

(51) Int. Cl.
*G03G 21/16* (2006.01)
*G03G 21/00* (2006.01)
(Continued)

(52) U.S. Cl.
CPC ..... *G03G 21/0029* (2013.01); *G03G 15/0812* (2013.01); *G03G 21/0011* (2013.01);
(Continued)

(58) Field of Classification Search
CPC ..... G03G 15/0812; G03G 21/0011; G03G 21/0029; G03G 21/1647; G03G 2221/1654
USPC ..... 399/126, 274, 284, 350, 351
See application file for complete search history.

(56) References Cited

U.S. PATENT DOCUMENTS 4,141,112 A 2/1979 Klemz
5,233,390 A 8/1993 Fujimoto
(Continued)

FOREIGN PATENT DOCUMENTS

CN 1324281 A 11/2001
CN 1340748 A 3/2002
(Continued)

OTHER PUBLICATIONS

Korean Notice of Allowance dated Aug. 25, 2014, in related Korean Patent Application No. 10-2011-0036133.
(Continued)

*Primary Examiner* — Benjamin Schmitt
(74) *Attorney, Agent, or Firm* — Fitzpatrick, Cella, Harper & Scinto

(57) ABSTRACT

A developer layer thickness regulating device includes a blade member for regulating a thickness of a layer of a developer on a surface of a developing roller rotatably supported by a developing container for accommodating the developer and includes a supporting member for supporting the blade member. The supporting member is capable of being fastened to a part of the developing container by a fastening member, and a position of the supporting member relative to a part of the developer container is adjustable with respect to a widthwise direction of the blade member, when the supporting member is fastened to the developing container by the fastening member, so as to fasten the blade member at a predetermined position relative to the developing container. The supporting member has a projection-recess portion which is capable of biting into the part of the developing container when the supporting member is fastened by the fastening member.

10 Claims, 13 Drawing Sheets

(51) Int. Cl.
*G03G 15/08* (2006.01)
*G03G 21/18* (2006.01)

(52) U.S. Cl.
CPC ..... *G03G21/1647* (2013.01); *G03G 21/1814* (2013.01); *G03G 21/169* (2013.01); *G03G 2215/0866* (2013.01); *G03G 2221/0015* (2013.01); *G03G 2221/1654* (2013.01)

(56) References Cited

U.S. PATENT DOCUMENTS 5,461,465 A 10/1995 Sunaga et al.
5,678,139 A 10/1997 Nomura et al.
6,266,500 B1 7/2001 Numagami et al.
6,266,502 B1 * 7/2001 Matsuzaki et al. ..... 399/111
6,280,122 B1 8/2001 Qvarth
6,282,395 B1 8/2001 Nittani et al.
6,298,203 B1 10/2001 Hashimoto et al.
6,411,791 B2 6/2002 Nittani et al.
6,438,347 B2 8/2002 Nittani et al.
6,535,709 B2 3/2003 Yokomori et al.
6,603,939 B1 8/2003 Toba et al.
6,622,001 B2 9/2003 Arimitsu et al.
6,654,583 B2 11/2003 Suzuki et al.
6,697,594 B1 2/2004 Murphy et al.
6,839,529 B2 1/2005 Yasui et al.
2004/0141781 A1 * 7/2004 Suda ..... 399/350
2009/0148208 A1 6/2009 Gauvin et al.

FOREIGN PATENT DOCUMENTS

JP 06-186887 A 7/1994
JP 06-317963 A 11/1994
JP 2000-275959 A 10/2000

OTHER PUBLICATIONS

Notification of the First Office Action dated Jul. 3, 2012, in Chinese Patent Application No. 201110098413.4.
Notification of the Second Office Action dated Feb. 21, 2013, in Chinese Patent Application No. 201110098413.4.

* cited by examiner

REGULATING DEVICE, IMAGE BEARING MEMBER CLEANING DEVICE, DEVELOPING DEVICE, CLEANING DEVICE, PROCESS CARTRIDGE AND IMAGE FORMING APPARATUS

This application is a divisional of application Ser. No. 13/085,710, filed Apr. 13, 2011.

FIELD OF THE INVENTION AND RELATED ART

The present invention relates to an image forming apparatus for forming a developer image on an image bearing member with a developer and thereafter by transferring the developer image onto a recording sheet such as paper to form an image. For example, there is an image forming apparatus of an electrophotographic type in which an electrophotographic photosensitive drum is used as the image bearing member and is subjected to selective exposure to form an electrostatic latent image and then the electrostatic latent image is developed as an developer image by depositing the developer on the electrostatic latent image by a developing device. In addition, there are an image forming apparatus of an electrostatic recording type in which an electrostatic recording dielectric material is used as the image bearing member and an image forming apparatus of a magnetic recording type in which a magnetic recording magnetic material is used as the image bearing member.

In a conventional electrophotographic image forming apparatus of the electrophotographic type, an electrophotographic photosensitive drum uniformly charged by a charging device is subjected to selective exposure to form an electrostatic latent image and then the electrostatic latent image is developed as a developer image by depositing a developer on the electrostatic latent image by a developing device. Thereafter, the developer image is transferred onto a recording sheet such as paper to form an image. Further, the electrophotographic photosensitive drum after the transfer of the developer image is subjected to removal of a residual developer, remaining on the surface thereof, by a cleaning device, and then is subjected to subsequent image formation. The electrophotographic photosensitive drum (member), and the charging device, for developing device or the cleaning device as a process means are integrally assembled into a cartridge, thus constituting a process cartridge. The process cartridge is configured to be detachably mountable to a main assembly of the electrophotographic image forming apparatus, so that a maintenance operation of a user is alleviated.

Such a developing device is constituted by connecting a developing roller, a developing blade for regulating a thickness of the developer to be coated on the developing roller, a developing device frame for supporting a developing member such as an application roller for applying the developer onto the developing roller, and a developer container which has accommodated the developer. Then, both ends of the developing blade are generally fixed with small screws so as not to be moved relative to the developer container.

In the above-constituted developing device, it has been required that the developing blade is positioned relative to the developing roller with high accuracy. When the position of the developing blade is unstable and the layer thickness of the developer on the developing roller is excessively large, a phenomenon that the developer is placed on a portion at which the developer should not be placed on the transfer material occurs. When the layer thickness of the developer on the developing roller is excessively small, such as a problem that a sufficient image density cannot be obtained occurs. In order to solve the problem by uniformizing the layer thickness of the developer on the developing roller, assembling has been performed by adjusting a mounting position of the developing blade relative to the developer container so as to accurately position an end (edge) of the developing blade relative to the developing roller (e.g., U.S. Pat. No. 6,298,203).

Further, with respect to the cleaning device, the photosensitive drum is rotatably mounted on a cleaning frame, and a cleaning blade, for removing the developer (untransferred toner) remaining on the photosensitive drum after the transfer, and a flexible sheet member are provided.

Then, the untransferred toner (residual toner) which has been removed from the photosensitive drum surface by the developing blade is contained in a residual toner container provided at a rear portion of the cleaning frame.

The important point for determining a constitution of the cleaning blade and its peripheral portion is that an entering amount of the cleaning blade with respect to the photosensitive drum is stabilized and that toner leakage is prevented. For that reason, similarly as in the case of the developing blade, the cleaning blade is assembled with the cleaning frame by adjusting a position of the cleaning blade so as to accurately position an end of the cleaning blade relative to the cleaning frame and is fixed with small screws.

In the image forming apparatus, it is important that the positions of the developing blade and the cleaning blade which have been mounted with high accuracy are not changed by the influence of a lapse of time, transportation or the like. For that reason, during the assembly of each of the blades, a fastening torque of the small screws and dimensional tolerance of parts was required to be strictly controlled.

SUMMARY OF THE INVENTION

A principal object of the present invention is to provide a developing blade capable of keeping a position of an end of the developing blade positioned relative to a developer carrying member with high accuracy.

Another object of the present invention is to provide a developing device including the developing blade, a cleaning blade, a cleaning device including the cleaning blade, and to provide a process cartridge and an image forming apparatus.

According to an aspect of the present invention, there is provided a developer layer thickness regulating device, comprising:

a blade member for regulating a thickness of a layer of a developer on a surface of a developing roller rotatably supported by a developing container for accommodating the developer; and a supporting member for supporting the blade member;

wherein the supporting member is capable of being fastened to a part of the developing container by fastening means, and a position of the supporting member relative to a part of the developer container is adjustable with respect to a widthwise direction of the blade member, when the supporting member is fastened to the developing container by the fastening means, so as to fasten the blade member at a predetermined position relative to the developing container, and wherein the supporting member has a biting portion which is capable of biting into the part of the developing container when the supporting member is fastened by the fastening means.

According to the present invention, the surface of the blade supporting member contacted to the container has a shape such that the surface bites into the container. As a result, the blade is assembled with the container and the blade supporting member is configured to bite into the (developing) container when the supporting member is fastened to the container by a fastening means, so that a position of the blade can be kept against the influences of a lapse of time and impact.

These and other objects, features and advantages of the present invention will become more apparent upon a consideration of the following description of the preferred embodiments of the present invention taken in conjunction with the accompanying drawings.

Figure 6:
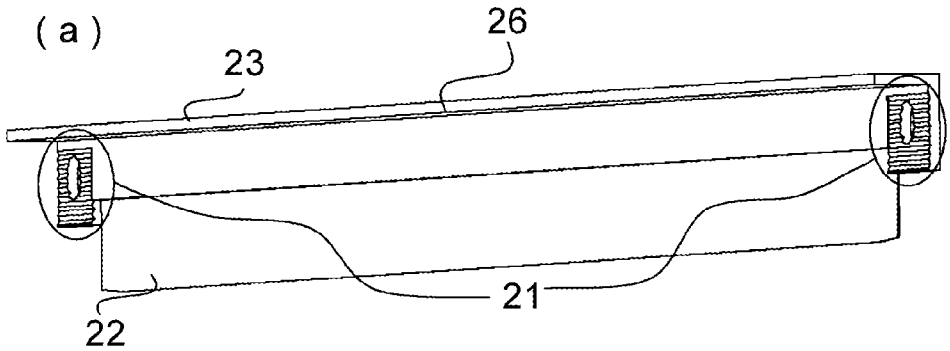
Figure 6:
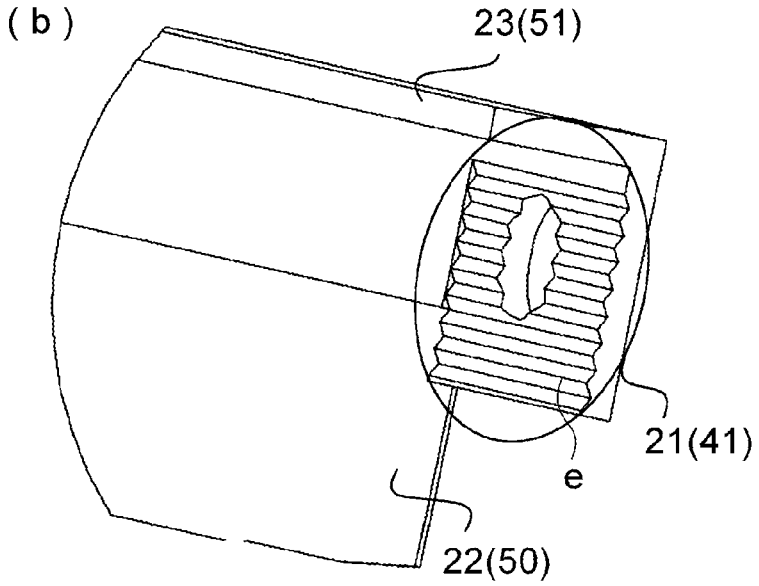

Part (a) of FIG. 6 is a schematic view showing a structure of a supporting member for the developing blade according to the embodiment of the present invention, in which a projection-recess portion of the supporting member has a parallel knurling shape. Part (b) of FIG. 6 is an enlarged view of an example in which the projection-recess portion of the supporting member for the developing blade or a cleaning blade according to the embodiment of the present invention has the parallel knurling shape.

Figure 7:
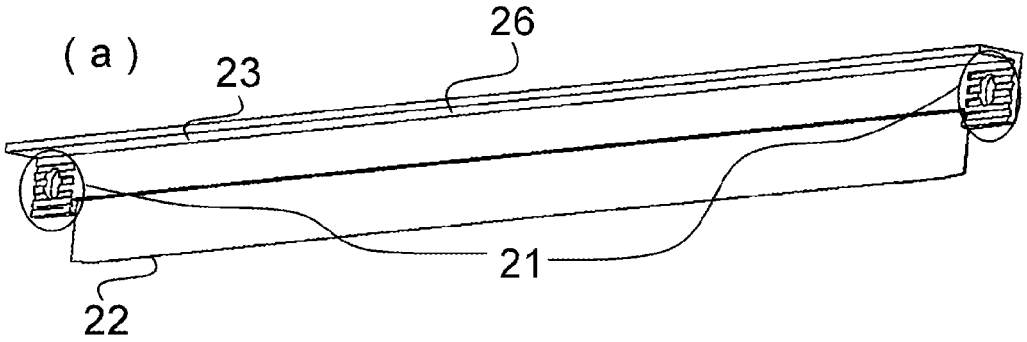
Figure 7:
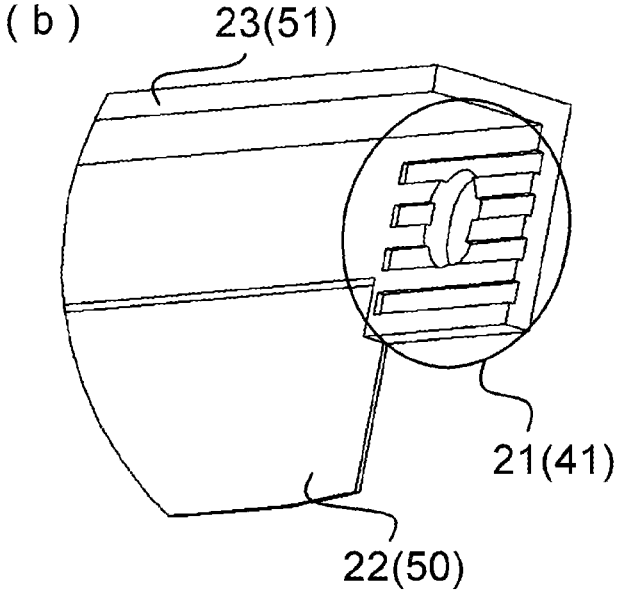

Part (a) of FIG. 7 is a schematic view showing a structure of a supporting member for the developing blade according to the embodiment of the present invention, in which a projection-recess portion of the supporting member has a parallel projection-recess shape. Part (b) of FIG. 7 is an enlarged view of an example in which the projection-recess portion of the supporting member for the developing blade or a cleaning blade according to the embodiment of the present invention has the parallel projection-recess shape.

Figure 8:
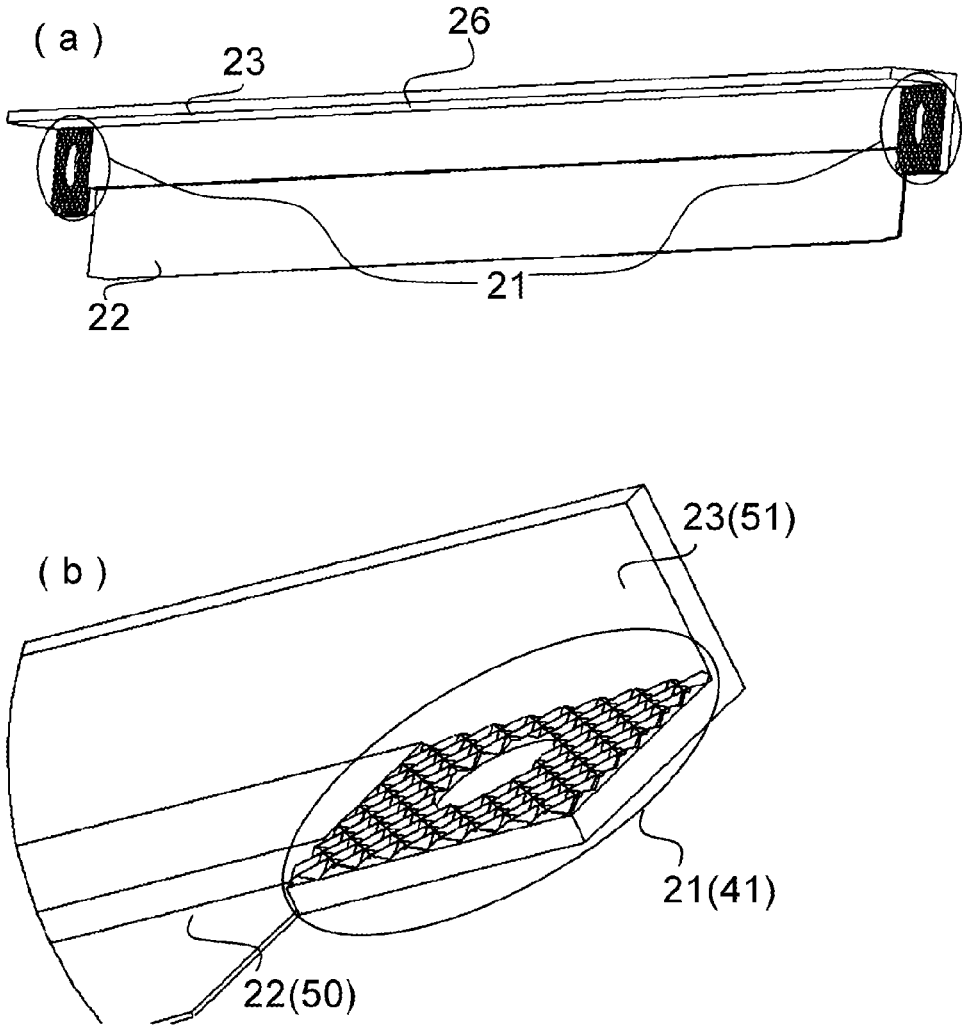

Part (a) of FIG. 8 is a schematic view showing a structure of a supporting member for the developing blade according to the embodiment of the present invention, in which a projection-recess portion of the supporting member has a double-cut knurling shape. Part (b) of FIG. 8 is an enlarged view of an example in which the projection-recess portion of the supporting member for the developing blade or a cleaning blade according to the embodiment of the present invention has the double-cut knurling shape.

Figure 9:
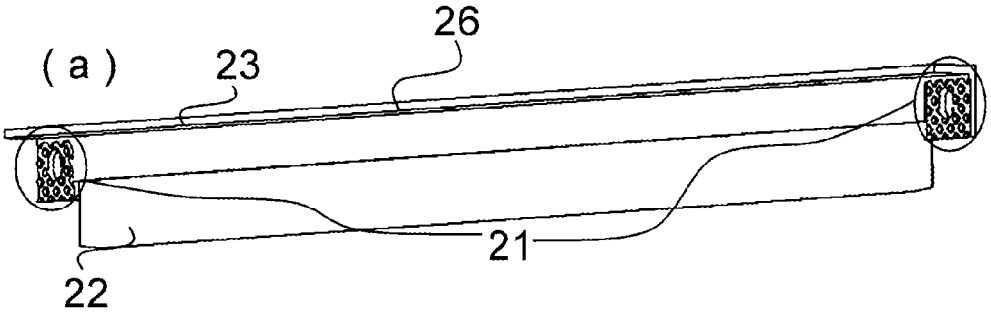
Figure 9:
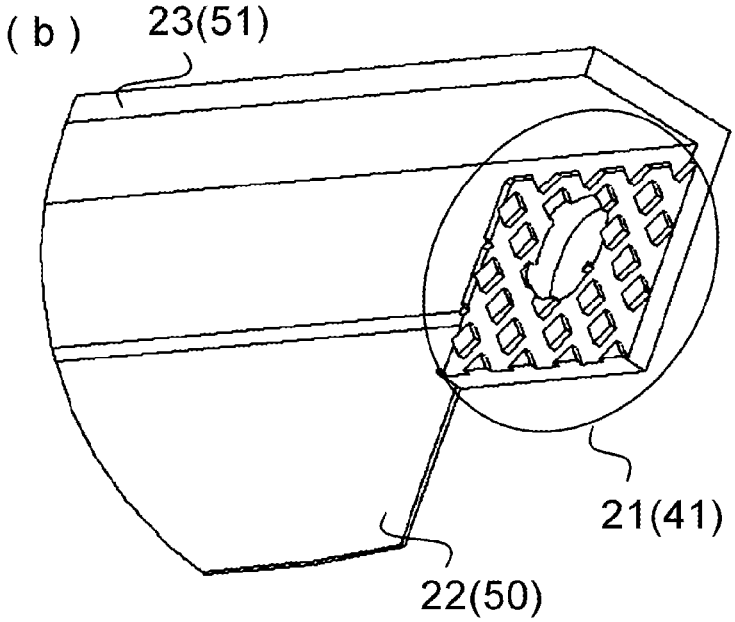

Part (a) of FIG. 9 is a schematic view showing a structure of a supporting member for the developing blade according to the embodiment of the present invention, in which a projection-recess portion of the supporting member has a double-cut projection-recess shape. Part (b) of FIG. 9 is an enlarged view of an example in which the projection-recess portion of the supporting member for the developing blade or a cleaning blade according to the embodiment of the present invention has the double-cut projection-recess shape.

Figure 10:
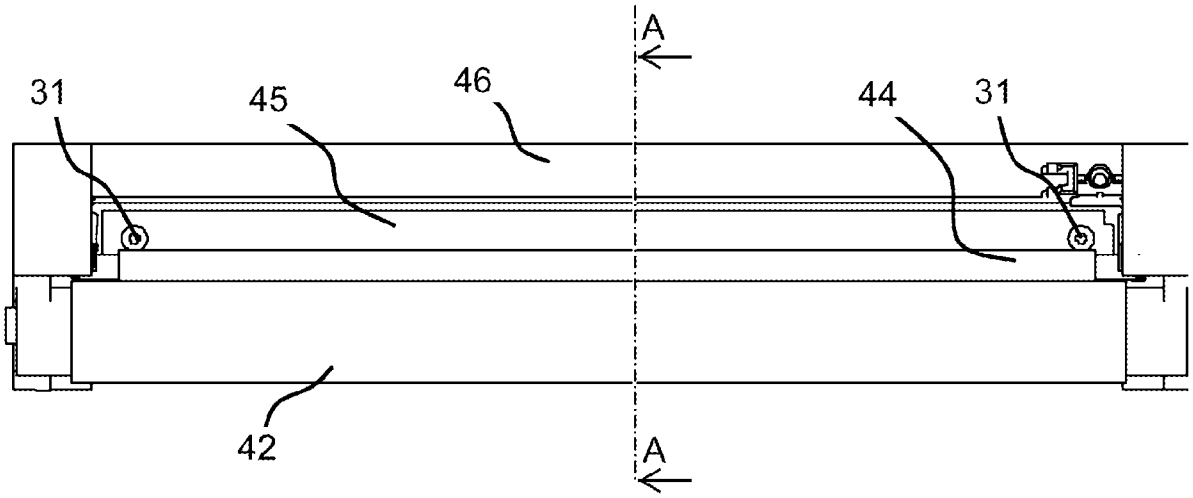

FIG. 10 is a general view of a cleaning unit in the embodiment of the present invention.

Figure 11:
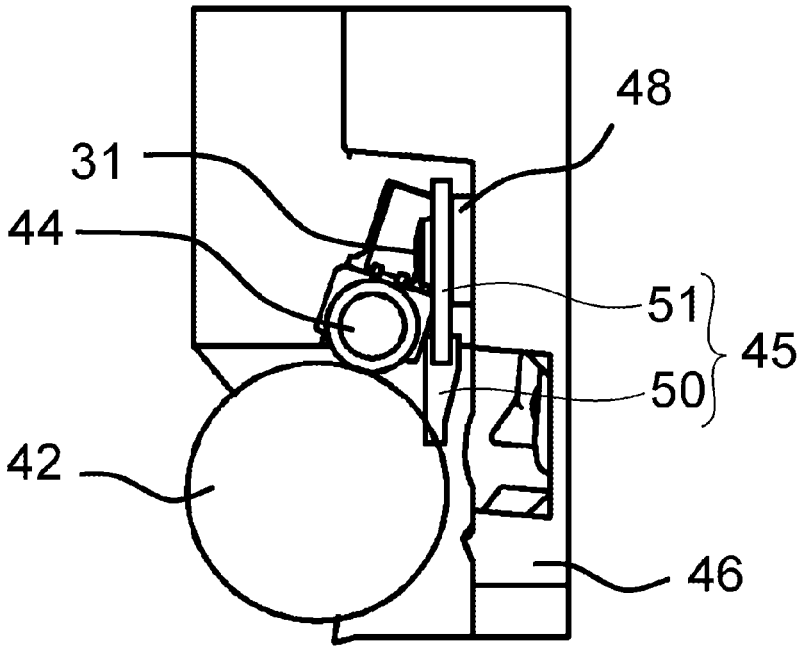

FIG. 11 is a sectional view of the cleaning unit taken along A-A line indicated in FIG. 10.

Figure 12:
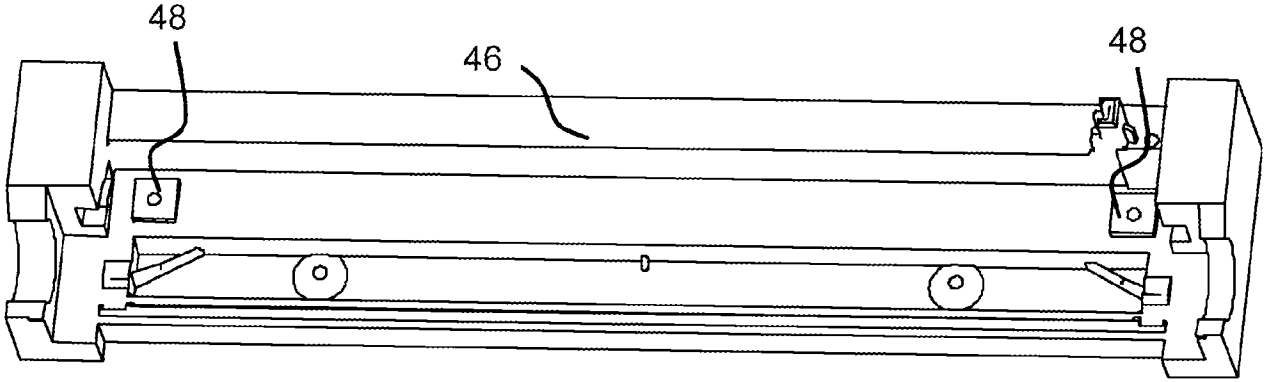

FIG. 12 is a general view of a cleaning frame in the embodiment of the present invention.

Figure 13:
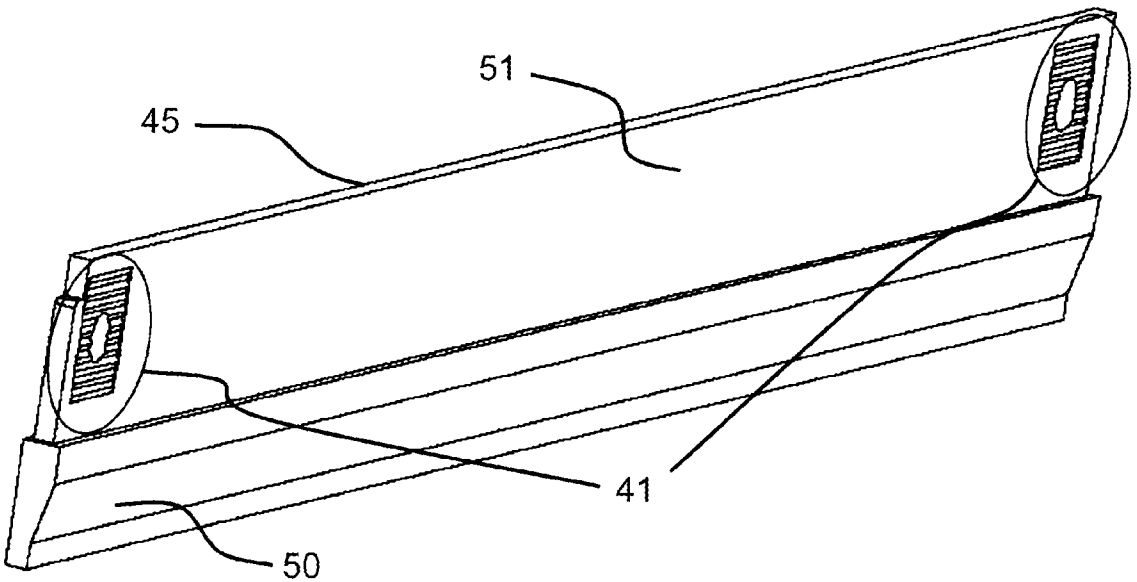

FIG. 13 is a general view of the cleaning blade according to the embodiment of the present invention.

DESCRIPTION OF THE PREFERRED EMBODIMENTS

Hereinbelow, embodiments of the present invention will be described with reference to the drawings.

First, a general structure of the entire image forming apparatus will be briefly described. Incidentally, in the following embodiments, the image forming apparatus of an electrophotographic type, such as a copying machine or a printer, and a developing device used in a process cartridge which is detachably mountable to a main assembly of the image forming apparatus will be described as an example.

(General Structure of Electrophotographic Image Forming Apparatus)

Figure 1:
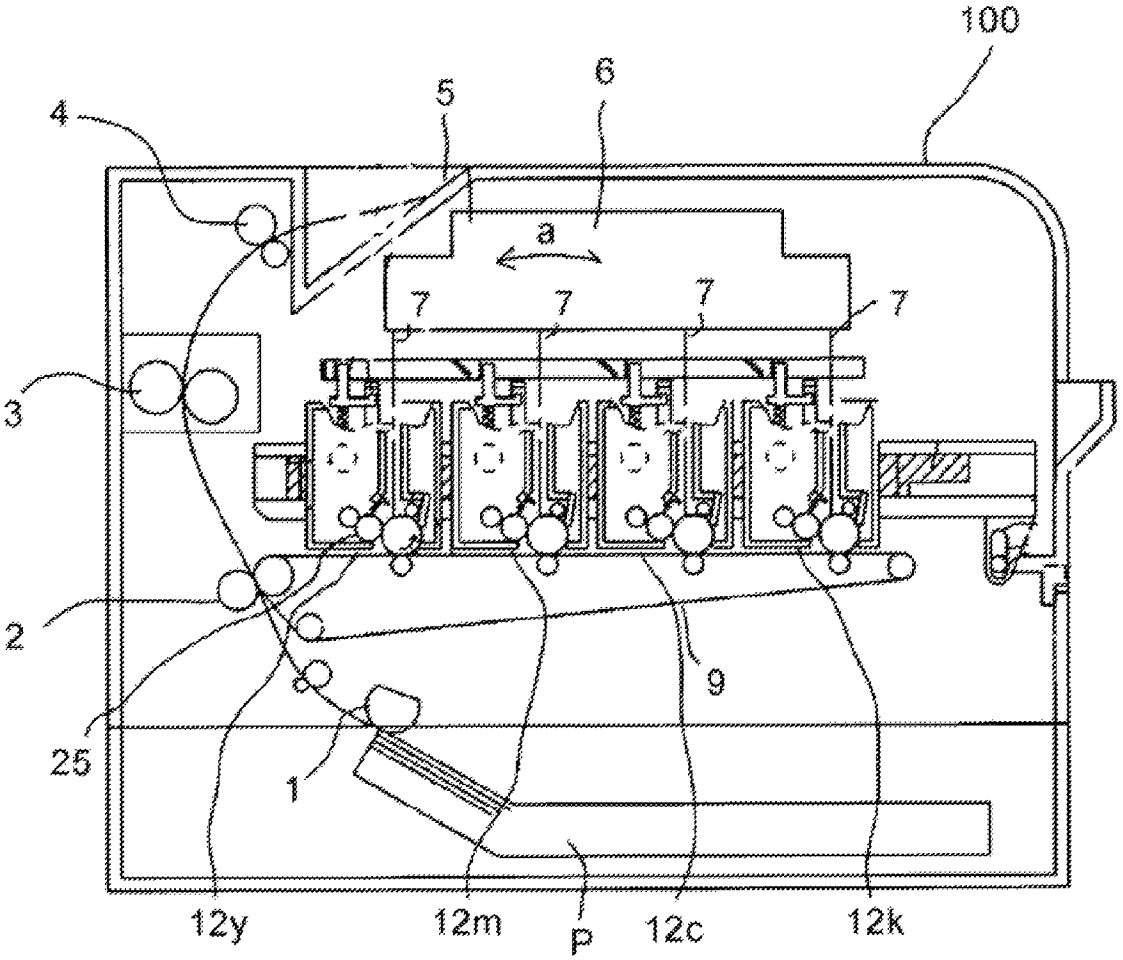
FIG. 1 is a general structural view of an image forming apparatus according to an embodiment of the present invention.

In an apparatus main assembly 100, as shown in FIG. 1, laser light 7 based on an image signal is sent from a laser scanner 6 to associated one of process cartridges 12*y*, 12*m*, 12*c* and 12*k*. By these process cartridges 12*y*, 12*m*, 12*c* and 12*k*, respective color toner images are successively primary-transferred onto a transfer belt 9. Thereafter, the toner images transferred on the transfer belt 9 are secondary-transferred, by a transfer roller 2, onto a recording material (medium) P conveyed by a (sheet) feeding roller 1. Thereafter, the recording material P is conveyed into a fixing unit 3 and the toner images transferred on the recording material P are fixed. Then, the recording material P on which the toner images are fixed is discharged on a discharge portion by a discharging roller pair 4.

(General Structure of Process Cartridge)

Next, the process cartridges 12*y*, 12*m*, 12*c* and 12*k* in this embodiment will be described with respect to FIG. 2. Here, the process cartridges 12*y*, 12*m*, 12*c* and 12*k* have the same constitution except that they accommodate toners different in color and therefore will be described hereinafter by using the process cartridge 12*y*. Incidentally, suffixes y, m, c and k represent yellow, magenta, cyan and black, respectively.

Figure 2:
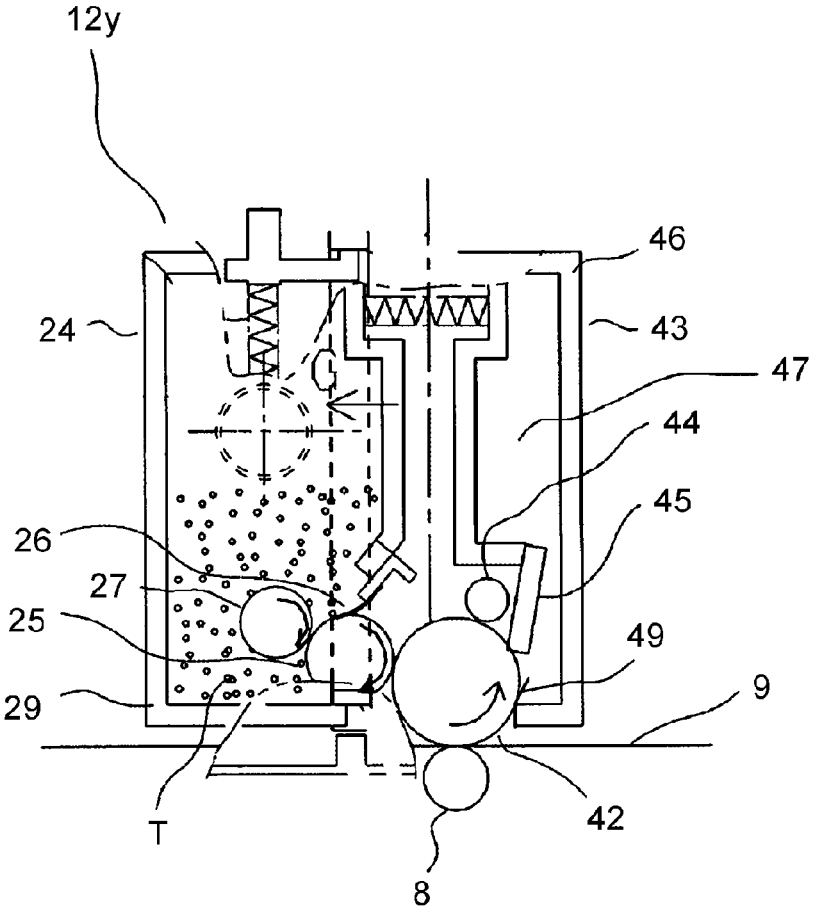
FIG. 2 is a sectional view of a process cartridge according to the embodiment of the present invention.

As shown in FIG. 2, the process cartridge 12*y* includes a photosensitive drum (image bearing member) 42 and process means acting on the photosensitive drum 42. Here, the process means includes a charging roller 44 for electrically charging the photosensitive drum 42, a developing roller 25 for developing a latent image formed on the photosensitive drum 42, an image bearing member cleaning device (hereinafter referred to as a cleaning blade) 45 for removing residual toner remaining on the surface of the photosensitive drum 42, and the like. Further, the process cartridge 12Y is divided into a cleaning unit (cleaning device) 43 and a developing unit (developing device) 24.

(Cleaning Unit)

The cleaning unit 43 is prepared by rotatably mounting the photosensitive drum 42 on a cleaning frame (cleaning container) 46. In addition, the charging roller 44 for uniformly charging a photosensitive layer provided at an outer peripheral surface of the photosensitive drum 42, the cleaning blade 45 for removing a developer left on the photosensitive drum 42 after the transfer, and a flexible sheet member 49 are provided. The residual toner removed from the surface of the photosensitive drum 42 by the cleaning blade 45 is contained in a residual toner chamber 47 which is provided at a rear portion of the cleaning frame 46. Further, untransferred toner on the photosensitive drum 42 passes through a drum contact portion of the flexible sheet member 49 and reaches a position of the cleaning blade 45. A contact condition of the flexible sheet member 49 is set so that the residual toner removed from the photosensitive drum 42 by the cleaning blade 45 is not leaked to the outside of the cleaning frame 46.

(Developing Unit)

The developing unit 24 is, as shown in FIG. 2, constituted by the developing roller 25, a developer layer thickness regulating device (hereinafter referred to as a developing blade) 26, a toner supplying roller 27, a developing device frame 29 and a bearing unit. The developing device frame 29 includes a toner accommodating portion for accommodating the toner to be supplied to the developing roller 25, and on the peripheral surface of the developing roller 25, the toner supplying roller 27 to be rotated in contact with the developing roller 25 and the developing blade 26 are disposed.

(Developing Method)

During the development, the toner accommodated in the developing device frame 29 is fed to the toner supplying roller 27, which supplies the toner to the developing roller 25 by sliding on the developing roller 25, so that the toner is carried on the developing roller 25. The toner carried on the developing roller 25 reaches a position of the developing blade 26 by the rotation of the developing roller 25 and is regulated by the developing blade 26 to form a predetermined thin toner layer, so that a desired charge amount of electric charge is imparted. The toner formed in the thin layer on the developing roller 25 is conveyed to a developing portion, at which the photosensitive drum 42 and the developing roller 25 contact each other, by the rotation of the developing roller 25. Then, by a developing bias applied from an unshown power source to the developing roller 25, at the developing portion, the toner is deposited on an electrostatic latent image formed on the surface of the photosensitive drum 42 to visualize the latent image. The toner which does not contribute to the development of the electrostatic latent image and remains on the surface of the developing roller 25 is returned to the inside of the developing device by the rotation of the developing roller 25, and then is separated from the developing roller 25 at a sliding portion between the developing roller 25 and the toner supplying roller 27 and thus is collected. The collected toner is mixed with remaining toner.

(Developing Blade)

Figure 3:
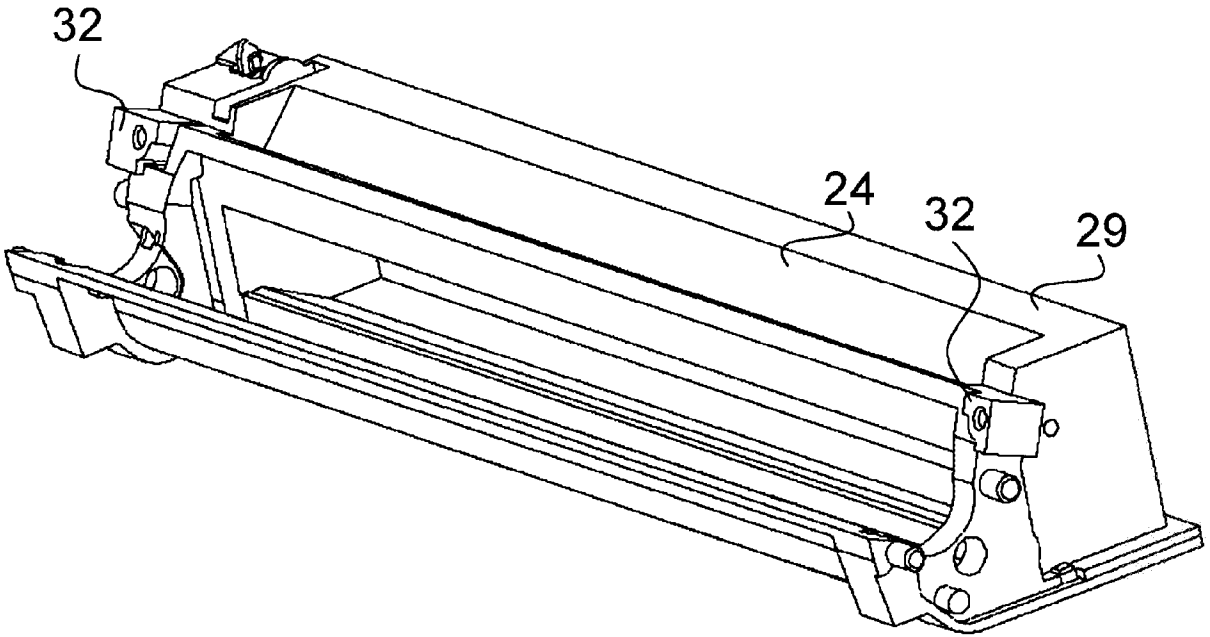
FIG. 3 is a general view of a developing device frame of a developing unit in the embodiment of the present invention.
Figure 4:
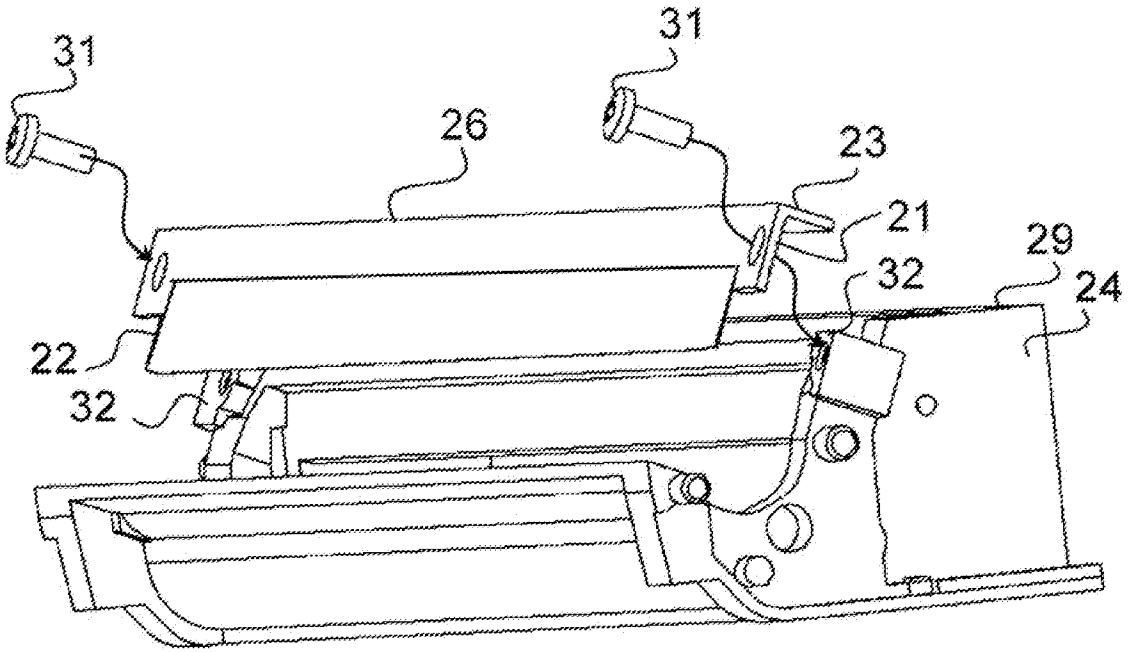
FIG. 4 is an exploded view of the developing device frame and a developing blade of the developing unit in the embodiment of the present invention.
Figure 5:
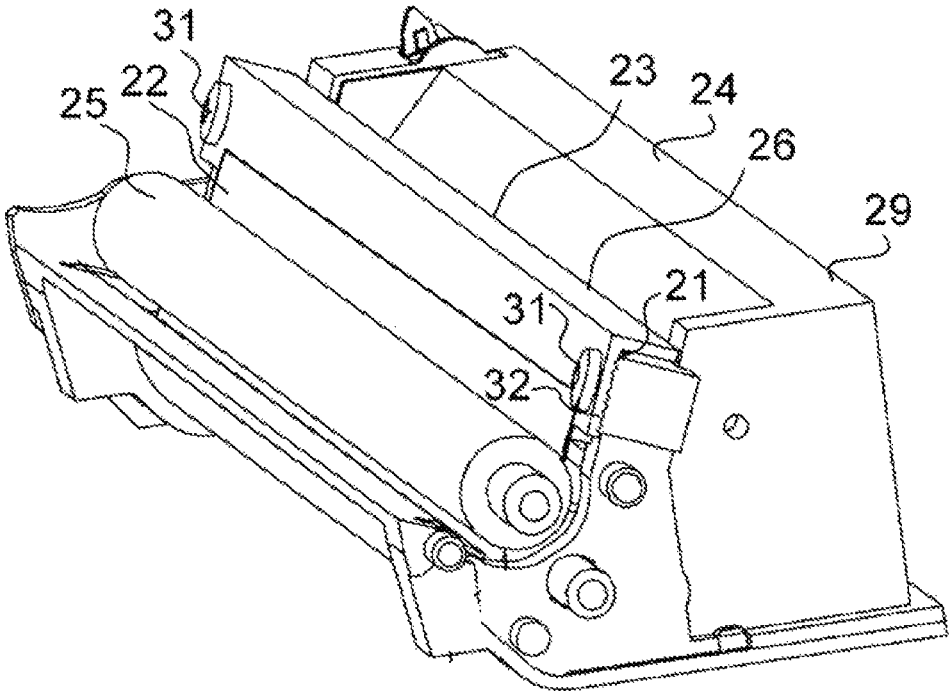
FIG. 5 is a general view of the developing unit in the embodiment of the present invention.

The developing unit 24 will be described more specifically with reference to FIGS. 3, 4 and 5.

The developing blade 26 regulates the toner on the developing roller 25 rotatably supported by the developing device frame 29 and is constituted by a regulating member 22 for regulating a layer thickness of the toner on the developing roller 25 and a supporting member 23 for supporting (holding) the regulating member 22 on the developing device frame 29. Incidentally, the supporting member 23 is required to have a strength in order to alleviate bending of the regulating member 22 with respect to a longitudinal direction, and thus a material for the supporting member 23 is generally metal.

The regulating member 22 may be manufactured by molding or rolling. The material for the regulating member 22 may be metal or resin. Further, the regulating member 22 is fixed on the supporting member 23 and a fixing method thereof may be welding and may also be bonding with an adhesive. Incidentally, in this embodiment, the supporting member 23 which has been bent in L shape is used to a shape of the entire developing blade 26 is not particularly limited.

The mounting of the developing blade 26 on the developing device frame 29 is performed by bringing the supporting member 23 into contact with a developing blade bearing surface 32 of the developing device frame 29. FIG. 4 shows a state of the developing device frame 29 and the developing blade 26 before the developing blade 26 is mounted.

In this embodiment, at a contact surface (biting portion) of the supporting member 23 with the developing blade bearing surface 32, an intermittent or continuous projection-recess shape is provided (hereinafter referred to as a supporting member projection-recess portion 21). For that reason, when the supporting member 23 is contacted to the developing blade bearing surface 32, the contact surface of the supporting member 23 is configured to bite into the developing blade bearing surface 32. At this time, as the shape of the supporting member projection-recess portion 21, e.g., a parallel knurling shape which is a three-dimensional shape having a plurality of edges e each extending in a direction parallel to the longitudinal direction of the developing blade 26 ((a) and (b) of FIG. 6) is used. The plurality of the edges e are provided in the direction parallel to the longitudinal direction of the developing blade 26, so that the developing blade 26 is less liable to be positionally deviated with respect to a widthwise direction when the supporting member projection-recess portion 21 bites into the developing device frame 29. Incidentally, as an example of the three-dimensional shape having the plurality of the edges e each extending in the direction parallel to the developing blade 26, that of the developing blade 26 shown in (a) and (b) of FIG. 7 can be cited. Further, a shape of a double-cut knurling ((a) and (b) of FIG. 8) having an intermittent or continuous projection-recess shape which extends in two directions crossing each other may be used. As a result, it is possible to prevent the positional deviation with respect to not only one direction but also a plurality of directions. Incidentally, as another example of such a shape, there is a shape as shown in (a) and (b) of FIG. 9. Incidentally, the shape of the bearing surface of the supporting member may also be any shape other than the above-described shapes if the shape is the projection-recess shape such that the bearing surface having the projection-recess shape bites into the developing container. As described later, the developing blade 26 is positionally adjustable with respect to the widthwise direction (perpendicular to the longitudinal direction thereof). For that reason, the projection-recess shape may preferably be provided with respect to a direction which crosses the widthwise direction. This is because the edges of the projection-recess shape bite into the developing device frame 29 and thus it is possible to suppress the deviation of the developing blade 26 in the widthwise direction.

Further, in order to effect high-quality image formation, the position of the developing blade 26 is required to be accurately aligned with the developing blade bearing surface 32 with respect to also the direction perpendicular to the bearing surface 32. Therefore, in order to accurately position the developing blade 26 relative to the developing blade bearing surface 32, projected portions of the supporting member projection-recess portion 21 may desirably be accurately formable in an area as wide as possible.

(Assembling Method of Developing Blade to Developing Device)

An assembling method of the developing blade 26 will be described with reference to FIGS. 3, 4 and 5.

The developing blade 26 is assembled to the developing device frame 29 by adjusting its position so that the layer thickness of the developer on the developing roller 25 can be uniformized to accurately position the edge of the developing blade 26 relative to the developing roller 25. As shown in FIG. 4, first, the developing blade 26 is temporarily positioned by being brought into contact with the developing device frame 29. As an adjusting method of positioning at a fixed position, there is a method of adjusting the edge position of the developing blade 26 by image processing or the like method. In this case, in a fixing method of fixing the developing blade 26 onto the developing device frame 29, both ends portions of the developing blade 26 are generally fixed on the developing device frame 29 with small screws (fastening means) 31. Holes into which the small screws 31 are to be inserted at the both end portions of the developing blade 26 are configured to have a diameter larger than that of the small screws 31. Further, the holes provided at the both end portions of the developing blade 26 are elongated holes extending in the widthwise direction so that the developing blade 26 is positionally adjustable with respect to the widthwise direction (perpendicular to the longitudinal direction of the developing blade 26). Until the developing blade 26 is completely fastened to the developing device frame 29 with the small screws 31, the supporting member projection-recess portion 21 of the developing blade 26 does not bite into the developing blade bearing surface 32. For that reason, the projected portions of the supporting member projection-recess portion 21 can be slid on the developing blade bearing surface 32, so that the position of the developing blade 26 is finely adjustable.

Here, when the developing blade 26 is fastened to the developing device frame 29 with the small screws 31, the supporting member projection-recess portion 21 bites into the developing blade bearing surface 32, thus being fixed. As described above, the holes at the both end portions of the developing blade 26 are adjustable with respect to the widthwise direction, so that the edge position of the developing blade 26 is accurately adjusted by the image processing or the like. Further, the edge portion of the supporting member projection-recess portion 21 is assembled by biting into the developing blade bearing surface 32 and therefore the edge position of the developing blade 26 can be supported even in the case where a fastening force of the small screws 31 is weaken by a lapse of time and in the case where impact is applied.

Here, as a constitution for preventing the positional deviation of the developing blade 26 from the developing blade bearing surface 32 of the developing device frame 29, it would be considered that a member for preventing sliding (hereinafter referred to as a sliding preventing member) is sandwiched between the developing blade 26 and the developing blade bearing surface 32. For example, as the sliding preventing member, it would be considered that a constitution in which an inner clip washer or a silicone coat is interposed between the developing blade 26 and the developing blade bearing surface 32. However, when the constitution in which the sliding preventing member is sandwiched is employed, with respect to the direction perpendicular to the developing blade bearing surface 26, the position of the developing blade 26 varies in an amount corresponding to tolerance of the thickness of the sliding preventing member. As a result, it becomes difficult to effect the high-quality image formation. Further, the number of parts is increased and thus costs of the parts and the assembling are also increased. On the other hand, in the constitution of the present invention, the developing blade 26 is directly provided with the projection-recess shape, so that the edge position of the developing blade 26 can be retained while keeping the positional accuracy equivalent to that of the conventional developing blade with respect to the direction perpendicular to the developing blade bearing surface 26 without increasing the costs of the parts and the assembling.

Incidentally, the developing device frame 29 is generally formed with a mold material from the viewpoints of the costs and mass production, and the supporting metal plate 23 of the developing blade 26 is generally formed of metal as described above. Therefore, an electrophotographic of the material for the developing blade bearing surface 32 is smaller than that of the material for the supporting member projection-recess portion 21. That is, the material for the blade bearing surface 32 is softer than that for the projection-recess portion 21 and therefore the projection-recess portion 21 bites into the blade bearing surface, so that the developing blade 26 is firmly fixed. Incidentally, a measuring method of the elasticity coefficient is in accordance with ISO standard such as ISO 527.

(Cleaning Blade)

A constitution of the cleaning blade 45 will be described with respect to FIGS. 10, 11, 12 and 13.

As shown in FIGS. 10 and 11, the cleaning blade 45 has the function of removing the residual toner from the surface of the photosensitive drum 42 in contact with the photosensitive drum 42 and then of collecting the residual toner in the cleaning frame 46. The cleaning blade 45 is constituted by an elastic member 50 for performing the cleaning and a supporting member 51 for supporting (holding) the elastic member 50 on the cleaning frame 46. The elastic member 50 is formed on the cleaning frame 46 by cast molding.

The important point for determining a constitution of the cleaning blade 45 and its peripheral portion is that an entering amount of the cleaning blade 45 with respect to the photosensitive drum 42 is stabilized and that toner leakage is prevented. For that reason, similarly as in the case of the developing blade 26, the cleaning blade 45 is required to be assembled with the cleaning frame by adjusting a position of the cleaning blade 45 so as to accurately position the edge of the cleaning blade 45 relative to the cleaning frame 46. Specifically, the mounting (assembling) of the cleaning blade 45 onto the cleaning frame 46 is generally performed by bringing the supporting member 51 into contact with a cleaning blade bearing surface 48 of the cleaning frame 46 and then by being fastened with the small screws (fastening means) 31.

Holes into which the small screws 31 are to be inserted at the both end portions of the cleaning blade 45 are configured to have a diameter larger than that of the small screws 31. Further, the holes provided at the both end portions of the cleaning blade 45 are elongated holes extending in the widthwise direction so that the cleaning blade 45 is positionally adjustable with respect to the widthwise direction (perpendicular to the longitudinal direction of the cleaning blade 45).

FIGS. 12 and 13 show a state of the cleaning frame 46 and the cleaning blade 45, respectively, before the cleaning blade 45 is mounted. Also with respect to the cleaning blade 45, a constitution similar to the constitution of the developing blade 26 is employed, so that the position of the cleaning blade 45 relative to the photosensitive drum 42 can be accurately assembled and thus the resultant state can be kept.

That is, at a portion where the supporting member 51 is contacted to the cleaning blade bearing surface 48, an intermittent or continuous projection-recess shape (hereinafter referred to as a supporting member projection-recess portion 41) is formed.

Further, when the supporting member 51 is fastened to the cleaning blade bearing surface 48 with the small screws 31, the supporting member projection-recess portion 41 bites into the cleaning blade bearing surface 32, thus being fixed. In this case, as the shape of the supporting member projection-recess portion 41, similarly as in the case of the shape of the developing blade 26, it would be considered that the parallel knurling shape ((b) of FIG. 6), the double-cut knurling shape ((b) of FIG. 8) and other projection-recess shapes ((b) of FIG. 7 and (b) of FIG. 9) are employed. The assembling method, an effect thereof and the like are similar to those of the above-described developing blade 26. Similarly as in the embodiment described above, the projection-recess shape may preferably be provided with respect to the direction crossing the widthwise direction of the cleaning blade 45. This is because the edges of the projection-recess portion 41 bites into the cleaning blade bearing surface 48 and thus it is possible to suppress the deviation of the cleaning blade 45 in the widthwise direction.

Incidentally, as the cleaning blade, the cleaning blade for removing the residual toner from the surface of the photosensitive drum 42 in contact with the photosensitive drum 42 is described but the cleaning blade is not limited thereto. For example, in the image forming apparatus in which the developer image is transferred from the photosensitive drum 42 onto the intermediary transfer belt and thereafter is transferred from the intermediary transfer belt onto the recording material, it is also possible to apply the cleaning blade for removing the residual toner from the surface of the intermediary transfer belt.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 096779/2010 filed Apr. 20, 2010 and 082640/2011 filed Apr. 4, 2011, which are hereby incorporated by reference.

What is claimed is:

1. An image bearing member cleaning device, comprising:

a blade member for removing a developer from a surface of an image bearing member for bearing an image of the developer in contact with the image bearing member;

a supporting member for supporting the blade member; and a cleaning container for collecting the developer, wherein the supporting member is fastened to a part of the cleaning container by a fastener, and a position of the supporting member relative to a part of the cleaning container is adjustable with respect to a widthwise direction of said blade member, when the supporting member is fastened to the cleaning container by the fastener, so as to fasten the blade member at a predetermined position relative to the cleaning container, and wherein the supporting member has a biting portion which is capable of biting into the part of the cleaning container when the supporting member is fastened by the fastener, wherein the part of the cleaning container is softer than the biting portion.

2. The image bearing member cleaning device according to claim 1, wherein the biting portion has an intermittent or continuous projection-recess shape with respect to a direction crossing the widthwise direction.

3. The image bearing member cleaning device according to claim 1, wherein the biting portion has a three-dimensional shape with a plurality of edges which are parallel to a longitudinal direction of the image bearing member cleaning device.

4. The image bearing member cleaning device according to claim 1, wherein the biting portion has an intermittent or continuous projection-recess shape with respect to two directions crossing each other.

5. The image bearing member cleaning device according to claim 1, wherein an elasticity coefficient of a material of the cleaning container is smaller than that of a material for the supporting member.

6. The image bearing member cleaning device according to claim 1, wherein the fastener is located in the biting portion.

7. The image bearing member cleaning device according to claim 1, wherein the biting portion is capable of biting into a flat part of the developing container.

8. A cleaning device comprising:

the image bearing member cleaning device according to claim 1; and the fastener comprises a screw for fastening the supporting member to a part of the cleaning container.

9. A process cartridge detachably mountable to a main assembly of an image forming apparatus, the process cartridge comprising:

a photosensitive drum;

a processing unit configured to develop a latent image formed on the photosensitive drum; and the cleaning device according to claim 8.

10. An image forming apparatus for forming an image by transferring an image of a developer formed on an image bearing member, the image forming apparatus comprising:

an image bearing member unit including a photosensitive drum and configured to form a latent image;

a processing unit configured to develop the latent image formed on the photosensitive drum; and the cleaning device according to claim 8.

* * * * *